US008477981B2

(12) United States Patent
Heck et al.

(10) Patent No.: US 8,477,981 B2
(45) Date of Patent: Jul. 2, 2013

(54) WATCH INCLUDING A BUILT-IN MICROPHONE IN THE WATCHCASE

(75) Inventors: Pascal Heck, Gland (CH); Paul Dinnissen, Wynau (CH); Frédéric Meylan, Neuchâtel (CH); Jean-Pierre Mignot, Areuse (CH)

(73) Assignee: The Swatch Group Research & Development Ltd, Marin (CH)

( * ) Notice: Subject to any disclaimer, the term of this patent is extended or adjusted under 35 U.S.C. 154(b) by 815 days.

(21) Appl. No.: 12/606,707

(22) Filed: Oct. 27, 2009

(65) Prior Publication Data

US 2010/0111333 A1 May 6, 2010

(30) Foreign Application Priority Data

Nov. 5, 2008 (EP) ..... 08168370

(51) Int. Cl.
*H04R 9/08* (2006.01)

(52) U.S. Cl.
USPC ..... 381/364; 381/333; 381/360; 381/365; 381/355

(58) Field of Classification Search
USPC ..... 368/13; 379/433.1; 381/333, 364
See application file for complete search history.

(56) References Cited

U.S. PATENT DOCUMENTS

| | | | | |
|---|---|---|---|---|
| 5,008,864 | A * | 4/1991 | Yoshitake | 368/10 |
| 5,251,189 | A * | 10/1993 | Thorp | 368/4 |
| 5,381,387 | A * | 1/1995 | Blonder et al. | 368/10 |
| 5,467,324 | A * | 11/1995 | Houlihan | 368/10 |
| 6,219,304 | B1 | 4/2001 | Mignot et al. | |
| 6,564,075 | B1 * | 5/2003 | Mitamura | 455/575.1 |
| 6,757,390 | B2 * | 6/2004 | Ito et al. | 379/433.1 |
| 6,775,206 | B2 * | 8/2004 | Karhu | 368/10 |
| 6,865,278 | B2 * | 3/2005 | Dubugnon et al. | 381/189 |
| 6,894,212 | B2 * | 5/2005 | Capano | 84/454 |
| 2002/0030094 | A1 | 3/2002 | Curry et al. | |
| 2005/0069156 | A1 | 3/2005 | Haapapuro et al. | |
| 2007/0195947 | A1 * | 8/2007 | Puumalainen | 379/354 |

FOREIGN PATENT DOCUMENTS

| | | |
|---|---|---|
| CH | 644 246 A | 7/1984 |
| WO | 2004/054213 A | 6/2004 |
| WO | 2004/068732 A | 8/2004 |

OTHER PUBLICATIONS

European Search Report issued in corresponding application No. EP 08168370, completed Jan. 29, 2009.

* cited by examiner

*Primary Examiner* — Curtis Kuntz
*Assistant Examiner* — Ryan Robinson
(74) *Attorney, Agent, or Firm* — Griffin & Szipl, P.C.

(57) ABSTRACT

A watch (1) has a microphone (16) placed in a watchcase (2), a bracelet (3) with two end parts respectively attached to two opposite sides of the case and at least one through aperture (7) made in a lateral wall (12) of the case. The through aperture defines a first sound wave guide channel, and opens into the case in the direction of said microphone. The microphone is connected in the case to a sound wave processing unit circuit (19) for voice recognition. The watch further includes an audio guide member (6) fitted with a second open sound wave guide channel that comes into direct contact with the external surface of the lateral wall of the case across an area (13) that extends on either side of the aperture so as to guide the sound waves towards said first channel. This guide member may be made in an end part of the bracelet. In this manner, any interference from reflecting cavities, edges or surfaces in said area close to the aperture can be removed or attenuated.

9 Claims, 2 Drawing Sheets

WATCH INCLUDING A BUILT-IN MICROPHONE IN THE WATCHCASE

This application claims priority from European Patent Application No. 08168370.8 filed Nov. 5, 2008, the entire disclosure of which is incorporated herein by reference.

FIELD OF THE INVENTION

The invention concerns a watch that has a built-in microphone in the watchcase. The watch also includes a wristband or bracelet that has two end parts, respectively attached to two opposite sides of the case, and at least one through aperture made in a lateral wall of the case to define a first sound wave guide channel. This through aperture opens into the case in the direction of said microphone, for the reception of sound waves by the microphone. A sound wave processing unit circuit is arranged in the case and connected to the microphone, used for voice recognition, for example.

BACKGROUND OF THE INVENTION

A microphone placed inside a watchcase may be used for recognising the watch user's voice. The microphone must thus be able to perform reproducible voice recording regardless of the position of the watch worn on a user's wrist. Further, the voice recording by the microphone must not depend upon the distance between the watch when worn and the user's skin, if the bracelet is tight or loose. Moreover, the possible influence of obstacles in the watch user's surroundings, i.e. furniture, walls or other objects, must be minimised as far as possible.

Acquisition of an audio signal by a watch may be influenced by reflective surfaces that generate echoes. These reflective surfaces may be, for example, a table, walls, the watch user himself, or prominent parts of the middle part of the watchcase. Signal acquisition may also be influenced by cavities that generate resonance, for example between the watchcase and the arm or between the horns of the case and the bracelet.

Another particular situation is when voice recognition is performed with the watch on a base attached to a computer. Significant reflections can be generated on the table and can alter the features of the audio signal that is recorded as the reference for future recognition when the watch is worn on the wrist. This leads to a very poor recognition rate, which is a drawback.

SUMMARY OF THE INVENTION

It is thus an object of the invention to overcome the aforementioned drawbacks by providing a watch that includes a built-in microphone in the case for optimum voice recognition, while minimising external influences as far as possible.

The invention therefore concerns a watch that includes a built-in microphone in the case, connected to a sound wave processing unit circuit, placed inside a watchcase, a bracelet having two end parts, respectively attached to two opposite sides of the case and at least one through aperture, which is made in a lateral wall of the case, to define a first sound wave guide, and which opens into the case in the direction of said microphone, for the reception of sound waves by the microphone, wherein the watch further includes an audio guide member fitted with a second open sound wave guide channel, said guide member coming into direct contact with the external surface of the lateral wall of the case, across an area that extends on either side of the aperture, to guide the sound waves towards said first channel, so as to remove or attenuate any interference from reflecting cavities, edges or surfaces in said area close to the aperture.

Particular embodiments of the watch are defined in the dependent claims 2 to 10.

One advantage of the watch according to the invention lies in the fact that the second sound wave guide channel, made in an audio guide member, guides the sound waves in the direction of the first channel in the through aperture without being influenced by cavities, edges, or surfaces that reflect sound waves and create interference. In order to do this, the audio guide member comes into direct contact with the external surface of the lateral wall of the case, on an area that extends on either side of the aperture. This enables, for example, a sound wave processing unit circuit, connected to the microphone and integrated in the case, to perform high quality voice recognition.

The guide member may advantageously be an end part of the bracelet connected to the case. This end part of the bracelet may be made of rubbery material that is compressed against the external surface of the lateral wall between two horns of the lateral case wall.

BRIEF DESCRIPTION OF THE DRAWINGS

The objects, advantages and features of the watch, which includes a microphone inside the case, will appear more clearly in the following description, made on the basis of at least one non-limiting embodiment illustrated by the drawings, in which.

DETAILED DESCRIPTION OF THE INVENTION

In the following description, all of the elements that conventionally make up a wristwatch type watch, which are well known to those skilled in the art in this technical field, will only be described in a simplified manner.

Figure 1:
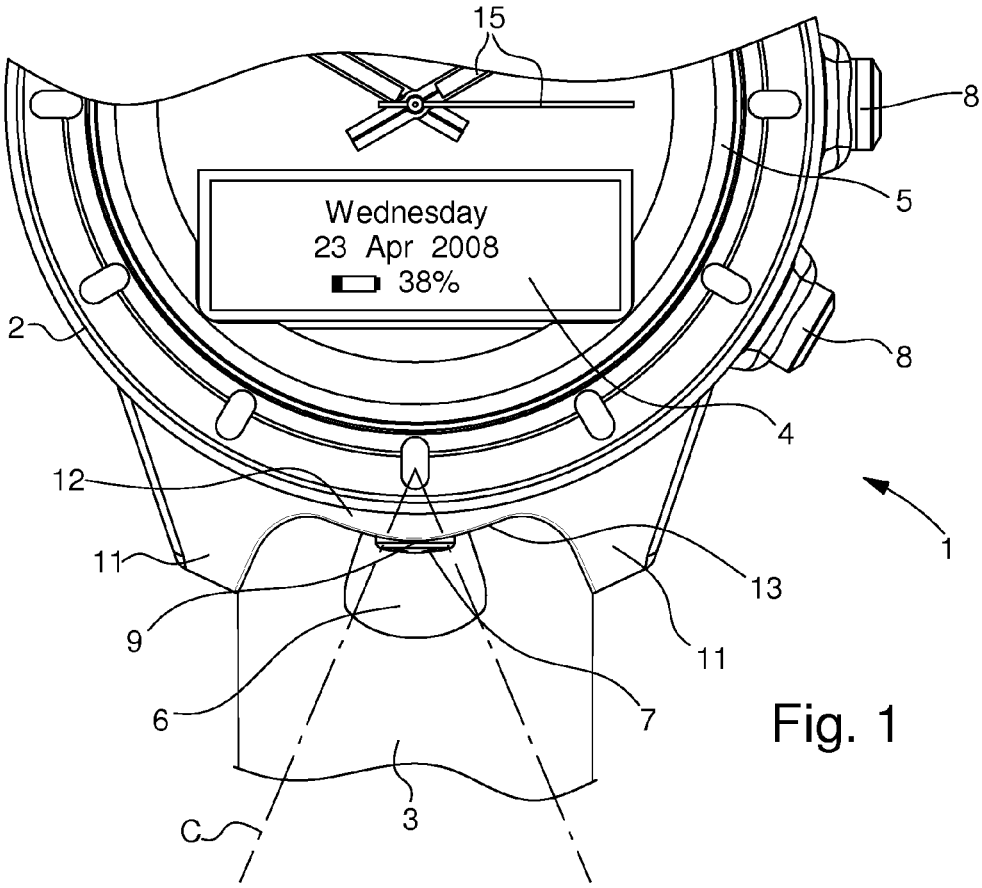
FIG. 1 shows a partial top view of a watch according to the invention.
Figure 2:
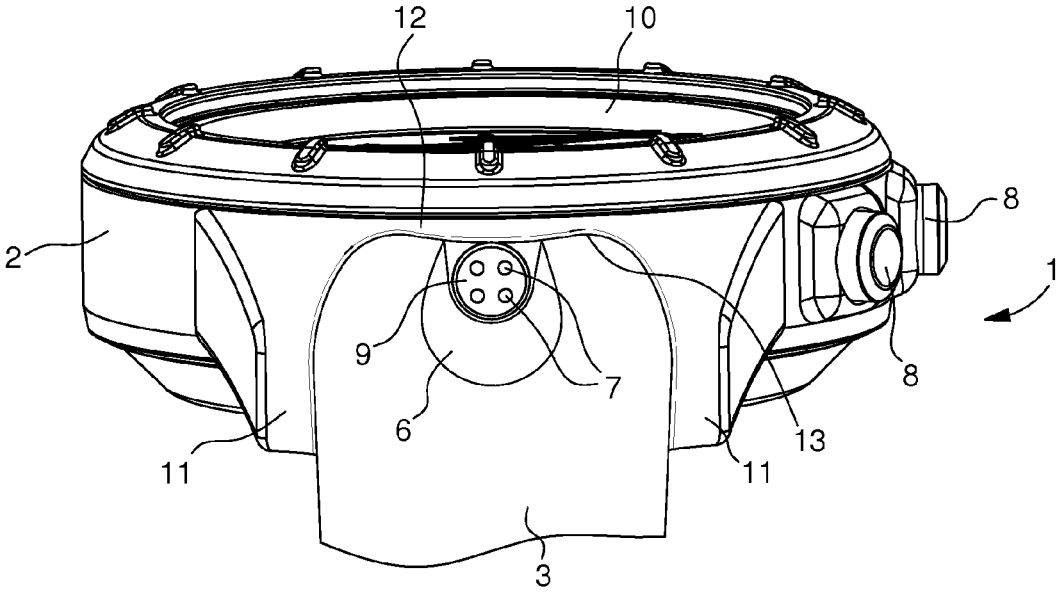
FIG. 2 shows a partial side view of a watch according to the invention, showing the aperture giving access to the microphone.
Figure 3:
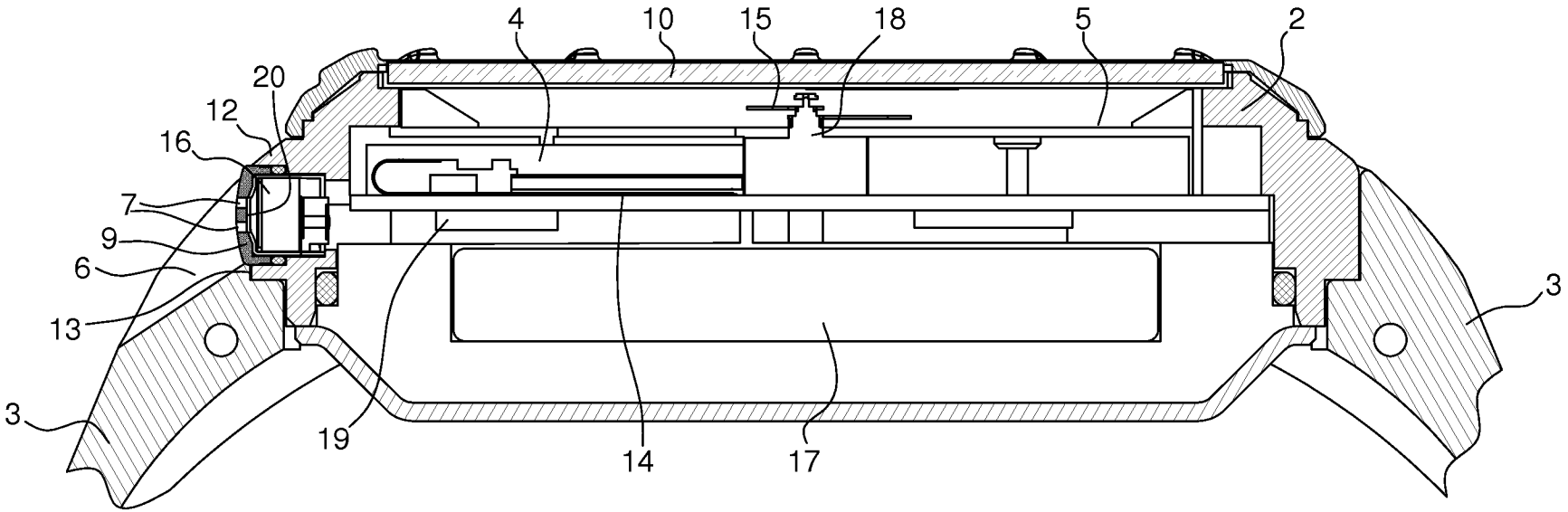
FIG. 3 shows a diametral cross-section in the longitudinal direction of a watch according to the invention.

Watch 1 according to the invention is shown in FIGS. 1 to 3, which show a partial top view, a partial side view and a partial, diametral cross-section in the 6 o'clock-12 o'clock direction of the wristwatch.

Watch 1 is of the wristwatch type and has a strap or bracelet 3, which has two end parts, respectively attached to two opposite sides of the case, between two horns 11 of a lateral wall 12 of case 2. The watch essentially includes at least one microphone 16, which is connected to a sound wave processing unit circuit 19. Microphone 16 and processing unit circuit 19, which is placed on a printed circuit board 14, are arranged inside case 2. Preferably, the microphone is positioned in one part of the middle part of case 2, i.e. in a lateral wall 12 of the case.

Watch 1 may include, in a conventional manner, one or more control buttons 8 on one side of lateral wall 12 of case 2, a tactile glass 10 fitted with various transparent electrodes, time indicator hands 15 on a dial 5, which are driven by motor means 18, an LCD liquid crystal display device 4 for displaying various data, and a battery or an accumulator 17 in the bottom of the case. Printed circuit board 14 may include several other electronic components, which are not described, for performing various conventional watch functions, including a time base circuit for driving the motor means.

One or several through apertures 7 are made in the lateral wall 12 of the case. The aperture or group of apertures 7 define a first sound wave guide channel, and open out into case 2 in the direction of said microphone 16, for the reception of sound waves by the microphone. Preferably, the circular through aperture(s) 7 are made in a plate in the form of a cover 9 in lateral wall 12, which is secured in a water-resistant manner in a cavity of the lateral wall. The number of through apertures can be for example equal to 4. A sealing membrane 20 may be placed between the microphone and through apertures 7 of plate 9 to protect the microphone from environmental constraints.

Watch 1 mainly includes an audio guide member, which may be integral with lateral wall 12 of the case, or preferably be one of the end parts of bracelet 3. This audio guide member is fitted with a second sound wave guide channel 6. Across an area 13 that extends on either side of through aperture(s) 7, said guide member comes into direct contact with the external surface of lateral case wall 12, so as to guide the sound waves towards said first channel. In this way, any interference from reflecting cavities, edges or surfaces is removed or attenuated in said area 13, close to the aperture(s).

If the sound waves are voice waves, better voice recognition can be performed by processing unit circuit 19, which is connected to microphone 16. The processing unit circuit can be directly connected to a memory unit, which contains personal data or stored commands. One or several vocal commands, spoken by the watch user and recognised by the processing unit circuit, can perform various operations or functions in the watch. More specific features of this kind of processing unit circuit combined with a microprocessor unit are defined in CH Patent No. 644 246, which is incorporated herein by reference.

At least the end parts of bracelet 3 of watch 1 are made of a rubbery material. This enables each end part of the bracelet to be mounted on two opposite sides of lateral wall 12 between two respective horns 11 of the lateral wall. Each end part of the bracelet is held in a fixed position with no rotation between the two horns 11, compressed against the external surface of lateral wall 12. One of the end parts of bracelet 3 can be used as audio guide member and thus comes into direct contact across an area 13 that extends either side of through aperture(s) 7. This area 13 also extends over the inner portions of horns 11.

The end part of the bracelet, used as audio guide member, includes a second open sound wave guide channel 6. This second open channel includes a cone-shaped portion, the axis of which is preferably arranged in the direction of a central reception area of microphone 16. The contact line of the second sound wave guide channel with the external surface of lateral wall 12 is U-shaped, and the base of the U defines an arc of a circle, centred relative to a through aperture for receiving sound waves, or relative to a group of through apertures 7 made in the lateral wall.

The second sound wave guide channel, which has cone-shaped portion and is made in the end part of the bracelet, is open on the side of a watch glass 10, i.e. on the side of the bracelet that is visible to the watch user. This second guide channel is thus arranged in the 6 o'clock indication position of an analogue time display. The top surface of the audio guide member on each side of the aperture of the second guide channel lies in the extension of the top surface of the two horns 11. This also prevents any interference from cavities or edges and ensures good sound wave reception through the first sound wave guide channel.

To ensure minimum influence from the immediate surroundings of microphone 16, the latter is placed, as indicated above, in the direction of the user, preferably at 6 o'clock. The microphone is protected by the bracelet, one end part of which forms the audio guide member. This audio guide member includes the second acoustic horn channel for masking any interference from the user's arm and other possible sources. The second sound wave guide channel thus formed in the audio guide member can favour a conical space C between watch microphone 16 and the user's mouth. However, it should be remembered that this does not form a barrier against all surrounding sounds in this field of acoustics, but it can prevent any interference from reflecting obstacles close to through aperture(s) 7.

Moreover, to favour the position of the watch in the vocal axis by the user, data is displayed on the LCD display device 4 of watch 1. This makes the user to align the watch in the direction of microphone 16 by reading the text on display device 4.

If watch 1 is placed on a base (not shown) resting on a table, the base should be raised to increase the distance from the table and thus reduce echoes. Moreover, the base is made with the fewest possible obstacles on the main acoustic path between microphone 16 and the user's mouth.

In addition to microphone 16 and sound wave processing unit circuit 19 for voice recognition, watch 1 may include a tactile glass 10, whose transparent electrodes are connected to another electrode signal processing circuit, which is not shown. In such case, watch operations or functions can be performed by a vocal command or by a command activated by a finger placed on at least one electrode of the tactile glass. More specific features concerning the combination of the two control means are disclosed in WO Patent No. 2004/054213, which is incorporated herein by reference.

From the description that has just been given, those skilled in the art can devise several variants of the watch with a microphone arranged inside the case, without departing from the scope of the invention defined by the claims. Several microphones may be provided, for example, two microphones arranged in the middle part in diametrically opposite positions at 6 o'clock and 12 o'clock. With two microphones, two acoustic guide members may be provided, each made in one of the respective end parts of the bracelet. The end parts of the bracelet may be made of plastic or another metallic or insulating material, for example.

What is claimed is:

1. A watch comprising:

(a) a watchcase;

(b) a sound wave processing unit circuit;

(c) at least one microphone connected to the sound wave processing unit wherein the microphone and the sound wave processing unit circuit are placed inside the watchcase;

(d) a bracelet having two end parts, respectively attached to two opposite sides of the watchcase;

(e) at least one through aperture made in a lateral wall of the watchcase, wherein the aperture defines a first sound wave guide channel, wherein the through aperture opens into the case in the direction of the microphone, for the reception of sound waves by the microphone; and (f) an audio guide member fitted with a second open sound wave guide channel, wherein the audio guide member is made in one of the end parts of the bracelet, and comes into direct contact with an external surface of the lateral wall of the case, across an area that extends on either side of the aperture, to guide the sound waves towards the first channel, so as to remove or attenuate any interference from reflecting cavities, edges or surfaces in an area close to the aperture;

wherein the a contact line of the second sound wave guide channel with the external surface of the lateral wall is U-shaped; and wherein the base of the U defines an arc of a circle that is centred relative to the through aperture for receiving sound waves, or relative to a group of through apertures made in the lateral wall.

2. The watch according to claim 1, wherein the audio guide member with the second sound wave guide channel that is made in one of the end parts of the bracelet is held in a fixed position in direct contact with the external surface of the lateral wall of the case that includes the through aperture, wherein the second guide channel guides the sound waves towards the first channel to remove or attenuate any interference from reflecting cavities, edges or surfaces in said area close to the aperture.

3. The watch according to claim 1, wherein the audio guide member is integral with the lateral wall of the case.

4. The watch according to claim 2, wherein the second sound wave guide channel includes a cone-shaped portion that is open on the side of a watch glass and arranged in one of the end parts of the bracelet in a 6 o'clock indication position of an analogue time display.

5. The watch according to claim 1, wherein the lateral wall of the case has several through apertures that are grouped together in a reception area for sound waves guided into the second guide channel.

6. The watch according to claim 2, wherein at least one of the end parts of the bracelet is made of rubbery material that includes the second sound wave guide channel, wherein the end parts of the bracelet is compressed against the external surface of the lateral wall in a fixed position between two horns of the lateral wall of the case.

7. The watch according to claim 1, wherein the sound wave processing unit circuit performs voice recognition with personalised data or commands stored in a memory unit, and in that one or several through apertures forming the first sound wave guide channel are made in a plate in the form of a cover for the lateral wall secured in a water-resistant manner in a cavity of the lateral wall.

8. The watch according to claim 7, wherein a sealing membrane is placed between the microphone and the at least one through aperture of the plate.

9. A watch comprising:

(a) a watchcase;

(b) a sound wave processing unit circuit;

(c) at least one microphone connected to the sound wave processing unit wherein the microphone and the sound wave processing unit circuit are placed inside the watchcase;

(d) a bracelet having two end parts, respectively attached to two opposite sides of the case;

(e) at least one through aperture made in a lateral wall of the case, wherein the through aperture defines a first sound wave guide channel, and wherein the through aperture opens into the case in the direction of the microphone, for the reception of sound waves by the microphone; and (f) an audio guide member fitted with a second open sound wave guide channel, wherein the audio guide member is made in one of the end parts of the bracelet, and comes into direct contact with an external surface of the lateral wall of the case, across an area that extends on either side of the aperture, to guide the sound waves towards the first channel so as to remove or attenuate any interference from reflecting cavities, edges or surfaces in an area close to the aperture, and wherein the second open sound wave guide channel has a cone-shaped portion, and wherein the axis of the cone-shaped portion is arranged in the direction of a central reception area of the microphone.

* * * * *